United States Patent [19]

Clarke

[11] 4,356,659

[45] Nov. 2, 1982

[54] TAKE-APART DOLL

[76] Inventor: William A. Clarke, 3420 Pine Tree Ter., Erie, Pa. 16506

[21] Appl. No.: 255,229

[22] Filed: Apr. 17, 1981

[51] Int. Cl.[3] ..... A63H 33/00

[52] U.S. Cl. ..... 46/22; 46/167

[58] Field of Search ..... 46/22, 135 R, 165, 167, 46/170, 151, 161, 115

[56] References Cited

U.S. PATENT DOCUMENTS 1,272,685 7/1918 Levis ..... 46/22

4,164,827 8/1979 Palumbo ..... 46/135 R X

FOREIGN PATENT DOCUMENTS 537366 2/1957 Canada ..... 46/135 R

*Primary Examiner*—Gene Mancene
*Assistant Examiner*—Mickey Yu
*Attorney, Agent, or Firm*—Ralph Hammar

[57] ABSTRACT

A take-apart doll in which the doll's eyes remain closed until the parts of the doll are completely reassembled, at which time the doll's eyes open.

7 Claims, 6 Drawing Figures

TAKE-APART DOLL

This invention is a take-apart doll for preschool children in which the doll's eyes are closed as though the doll were asleep when the doll is apart, and the final act of reassembly causes the doll's eyes to open as though the doll had come awake.

Figure 1:
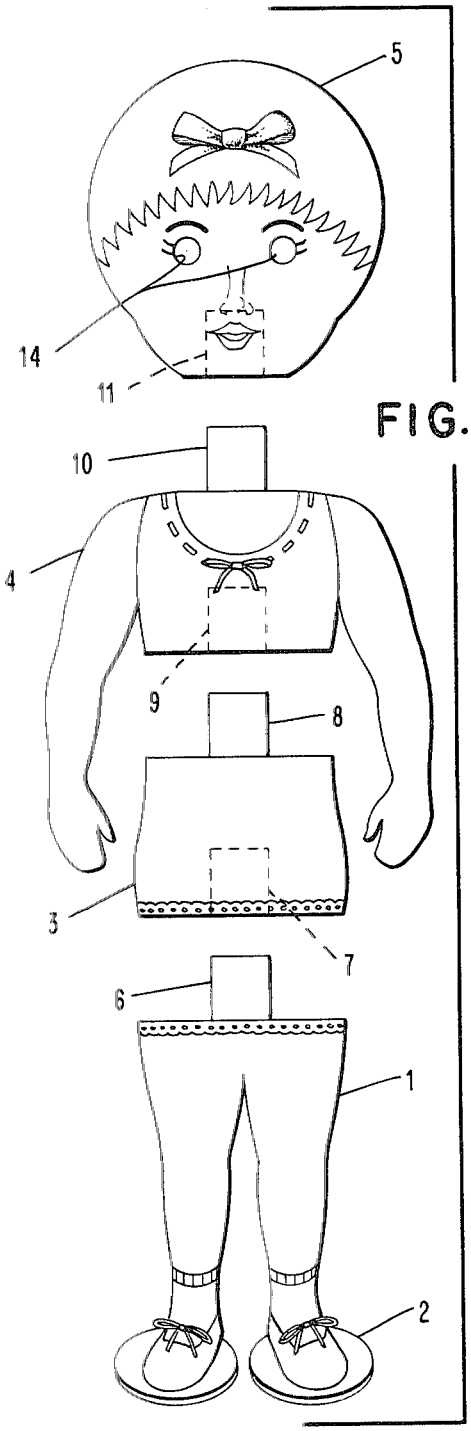
FIG. 1 is an exploded view of the parts of the doll.

The doll comprises any convenient number of parts, for example, a base or leg section 1 having disc shaped feet 2 at the lower end providing a stable support for the doll, a lower torso section 3, a shoulder and arm section 4, and a head section 5. At least the front of each of the sections is preferably painted to represent the corresponding portion of a doll and its clothing.

Figure 5:
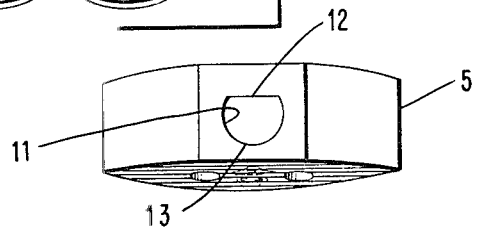
FIG. 5 is an edge view of the head section of the doll.

The sections are connected together by pin and socket connections constructed and arranged so that the sections must be assembled in a particular order and must be properly oriented with respect to the adjoining sections. A convenient structure for accomplishing this comprises a noncircular pin 6 upstanding from the leg section 1 fitting into a noncircular socket 7 in the lower end of the torso section 3, a noncircular pin 8 upstanding from the torso section 3 fitting into a noncircular socket 9 in the lower end of the shoulder and arm section 4, and a noncircular pin 10 upstanding from the shoulder section 4 and fitting into a noncircular socket section 11 in the lower end of the head section 5. These noncircular sections, which may be of any desired form, require proper orientation of the sections to be assembled. Furthermore, by reason of size or other characteristic, the pin 6 cannot be assembled into the sockets 9 or 11, but must be assembled into the socket 7. Similar requirements exist for the pins 8, 10 and sockets 9, 11. There are many expedients available for insuring proper orientation of the assembled parts. For example, as shown in FIG. 5, the socket 11 might have a curved surface 13 intersecting the flat surface 12. Complementary surfaces on the pin 10 and socket 11 compel the head to line with the shoulder section 4 as the pin 10 is inserted in the socket 11.

Figure 2:
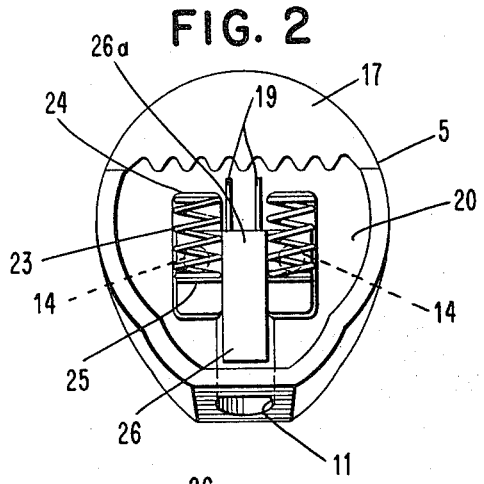
FIG. 2 is a rear view of the doll's head, with the back cover partly broken away to expose the working parts.
Figure 3:
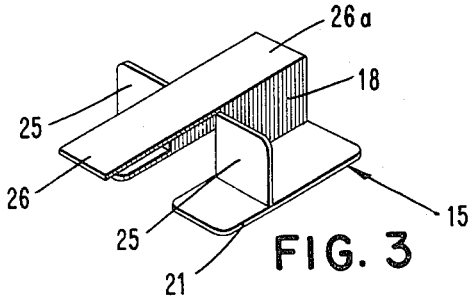
FIG. 3 is a rear view of the slide which carries the doll's eyes.
Figure 4:
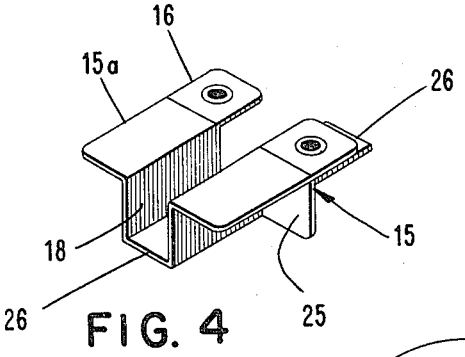
FIG. 4 is a front view of the slide.

In the disassembled position of the head section 5 shown in FIGS. 1 and 2, holes 14 in the front wall or face of the head section are closed by a slide 15 having portions **15*a* colored to represent the eyelids. In the assembled position of the head section, the slide is moved inward so that sections 16 painted to represent eyes register with the inner ends of the holes 14. The mechanical means for effecting the movement of the slide consists of an operative connection between the projection or pin 10 on the shoulder section and the slide 15. A preferred means for effecting the eye opening and eye closing movement of the slide is illustrated in FIGS. 2–5**.

Figure 6:
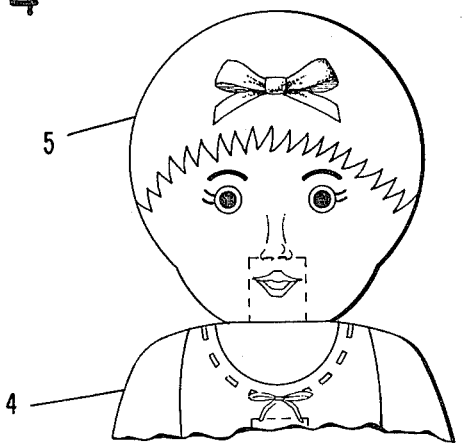
FIG. 6 is a view of the upper part of the doll showing the head section assembled on the shoulder section.

The head section 5 of the doll is hollow, and the back is closed by a plate 17 which has been broken away in FIG. 2 to uncover the slide moving means. The slide 15 has a channel section 18 telescoped over tracks or spaced ribs 19 outstanding from the back side 20 of the head section 5. The eyelid and eye sections **15*a*, 16 of flanges 21 ride over the surface 20 and the web 26*a* of channel 18 rides on the ribs 19. A spring 23 arranged between a stop 24 on the headpiece 5 and a seat 25 on the channel 18 biases the slide to the eyes closed position in which the eyelid sections 15*a* register with holes 14. In this position, a tab 26 which is an extension of the bottom wall or web 26*a* of channel 18 is within the socket 11 in line with the flat surface 12 of socket 11. When the pin 10 enters the socket 11, the pin engages the tab 26. The tab 26 and the pin 10 are so related that, upon the final positioning of the head section on the shoulder section of the doll, the eyes move from the closed to the open position, and the doll comes awake, as shown in FIG. 6**.

The doll is of great interest to preschool children. The aligning of the sections required for proper assembly teaches coordination. The awakening of the doll by the final assembly of the head on the shoulders is a reward for proper assembly. Children of this age group play with the doll for hours at a time, taking it apart and putting it together, and are always pleased when the doll comes awake.

I claim:

1. A toy comprising a plurality of parts constructed to represent features of a doll, releasable connectors between adjoining parts permitting a child to play with the doll by disassembling and reassembling said parts, one of said parts having eyes movable between open and closed positions, and means operatively connected to said eyes for moving said eyes from open to closed position upon disassembly of said parts and for moving said eyes from closed to open position upon reassembly of said parts.

2. The toy of claim 1 in which the connectors are constructed to require a particular sequence of reassembly of the parts.

3. The toy of claim 1 in which the connectors comprise a pin on one part and a socket in the part to be assembled on said one part.

4. The toy of claim 3 in which the means is within the socket.

5. The toy of claim 3 in which the part having the eyes has a front wall with holes in the positions for the eyes and a slide on the rear of said front wall having a first portion visible through said holes representing the eyes, a second portion visible through said holes representing the eyelids, and the opening and closing of the eyes is effected by respectively moving said first and then said second portions of the slide into register with said openings.

6. The toy of claim 5 in which the first and second portions of the slide are flanges on a channel riding on the rear surface of said front wall.

7. The toy of claim 6 in which the channel has a web extending into said socket in position to be engaged by said pin.

* * * * *